United States Patent [19]

Gilbert

[11] Patent Number: 4,899,564

[45] Date of Patent: Feb. 13, 1990

[54] DOORKNOB SECURITY DEVICE

[76] Inventor: Leamon A. Gilbert, Route 3, Box 479, Benson, N.C. 27504

[21] Appl. No.: 201,941

[22] Filed: Jun. 3, 1988

[51] Int. Cl.[4] ..... E05B 17/14

[52] U.S. Cl. ..... 70/428; 70/424

[58] Field of Search ..... 70/428, 427, 423, 424, 70/425, 426, 209, 210, 211, 212

[56] References Cited

U.S. PATENT DOCUMENTS

| | | | |
|---|---|---|---|
| 1,439,552 | 12/1922 | Johnson | 70/428 |
| 4,226,104 | 10/1980 | Oliver | 70/423 |
| 4,285,221 | 8/1981 | Atchisson | 70/428 |
| 4,503,692 | 3/1985 | Grint | 70/424 |
| 4,570,470 | 2/1986 | Gray | 70/428 |
| 4,631,938 | 12/1986 | Johnson | 70/427 |

*Primary Examiner*—Robert L. Wolfe

*Attorney, Agent, or Firm*—Rhodes, Coats & Bennett

[57] ABSTRACT

The present invention entails a doorknob security device for preventing access to the outer surface of the doorknob and particularly to a keyhole or other locking and unlocking mechanisms formed about the surface of the knob. In particular, the security device of the present invention comprises an outer main housing and a rotatable inner closure panel. The inner closure panel is rotatable from a closed to an open position. In the open position the security device easily accepts a doorknob. In the closed position the security device encompasses and closes the doorknob preventing access to the same.

6 Claims, 3 Drawing Sheets

DOORKNOB SECURITY DEVICE

FIELD OF THE INVENTION

This invention relates to doorknob security devices which encapsulate a doorknob and obstruct access to the key slot therein.

BACKGROUND OF THE INVENTION

It is an unhappy reality of societal life that persons' homes, offices and other private rooms are subject to unlawful entry by thieves, vandals, and worse. Although doors to these places are fitted with lockable doorknobs, they can be opened fairly quickly by a professional lock-picker.

Also, some unscrupulous persons have been known to retain keys they have once been issued for a hotel or motel room, office or the like and use that key to gain admittance to the room at a later time when someone else is in occupancy.

These situations create the need for additional security devices which will make unlawful entry, if not impossible, at least so much more difficult as to be discouraging.

Additional doorknob security devices have been devised and are described in U.S. Pat. Nos. 3,167,945; 4,226,104; and 4,503,692.

U.S. Pat. No. 3,167,945 shows two types of two-piece security devices which are drawn around the doorknob from top and bottom directions and locked together with a sliding ratchet-type lock. This device does not completely enclose the knob, being open at the sides in order to fit snugly, its shape must conform closely to that of the knob. This would present a problem in using this device for security where the doorknob shape is variable, as when traveling.

In U.S. Pat. No. 4,226,104 a doorknob protector is disclosed which consists of a dome-shaped cover magnetically sealed over a doorknob and including a lever insertable into an opening in the top of the dome-shaped cover for its removal. Clearly such a device is not very effective security for the door lock as any instrument practically could be used to pry off the cover.

In U.S. Pat. No. 4,503,692, the device shown does fully enclose a doorknob but is provided with an opening to permit access with a key. This is because there is no way provided to remove the cover while the door is closed.

SUMMARY AND OBJECTS OF THE INVENTION

The present invention is a doorknob security device which completely surrounds and encloses a doorknob to prevent access to the key slot therein and which also prevents anyone from turning the doorknob itself.

Broadly, the doorknob security device comprises an outer housing and an inner closure panel rotatably contained therein. When the closure panel is rotated to a closed position, the doorknob security device completely encompasses and secures the entire doorknob. Both the closure panel and outer housing have openings which are aligned when the device is rotated to an open position to allow the device to be easily slipped on or off the knob. All edges of the housings are underlapped and overlapped to prevent their being pried apart. Provision is made to lock the device in the closed position.

It is therefore an object of the present invention to provide a doorknob security device which will completely encompass and enclose a doorknob and thereby prevent same from being turned.

It is another object of the present invention to provide a doorknob security device which encloses a doorknob and prevents access to the key slot therein.

It is another object of the present invention to provide a doorknob security device which can enclose a variety of doorknob shapes and sizes.

It is another object of the present invention to provide a doorknob security device which provides a high level of security.

It is another object of the present invention to provide a doorknob security devise which can be readily used without aid of additional tools.

It is another object of the present invention to provide a doorknob security device which is simple and economical.

A further object of the present invention resides in the provision of a doorknob security device that not only prevents key access to an outer knob but also enables an inner knob to be secured, thereby making it difficult to gain entrance by simply breaking a glass pane in a door and unlocking the door from the inside.

Also an object of the present invention resides in the provision of a doorknob security device of the character referred to above that is relatively small and of a lightweight construction that enables the same to be easily carried by an individual while traveling.

Other objects and advantages of the present invention will become apparent and obvious from a study of the following description and the accompanying drawings which are merely illustrative of such invention.

DETAILED DESCRIPTION OF THE INVENTION

With further reference to the drawings, the doorknob security device of the present invention is shown therein and indicated generally by the numeral 10.

Figure 2:
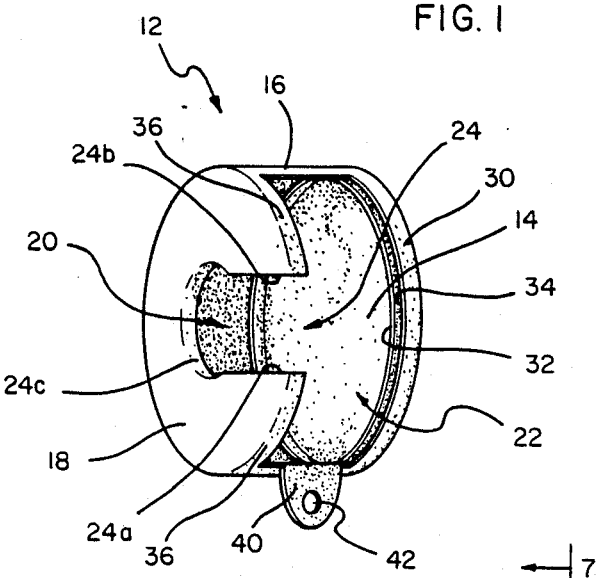
FIG. 2 is a perspective view of the outer housing of the doorknob security device.
Figure 3:
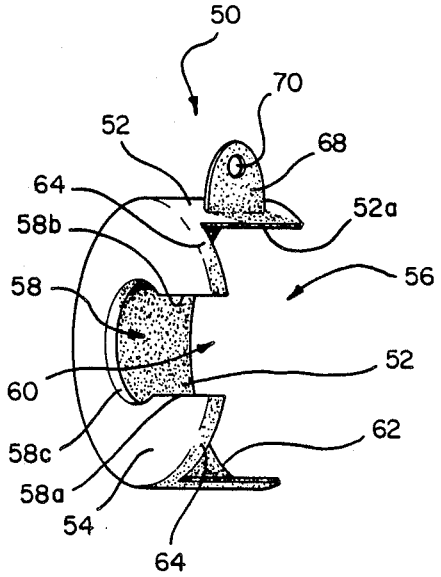
FIG. 3 is a perspective view of the inner closure panel of the doorknob security device.

As illustrated in FIGS. 2 and 3, the doorknob security device comprises two main components, an outer housing 12, and an inner closure panel 50.

Turning to FIG. 2, the outer housing 12 is of a hollow cylindrical shape, having various openings and comprising broadly a front wall 14, a partial circumferential side wall 16, and a back wall 18.

A doorknob access opening 20 is formed in the side and back walls and includes a side wall opening 22 which extends about 150 degrees around the circumferential side wall 16. It is noted that side wall opening 22 is bounded by a pair of arcuate flanges 30 and 36. Further, the doorknob access opening 20 comprises a keyhole-shaped opening 24 contiguous with the side wall opening 22. This keyhole-shaped opening 24 is formed by a circular opening centered in the back wall 18 and a slot opening extending radially to connect with the side wall opening 22. The keyhole-shaped opening 24 is defined by edges **24*a* and 24*b* of the slot opening and an arcuate stem opening flange 24*c* which is directed towards the interior of the outer housing 12**.

A groove or track 34 extends without interruption circumferentially inside the side wall 16 and contiguous flange 30. The track 34 is bounded on the inside by another flange 32 of a height which matches that of the flange 30.

A locking tab 40 is provided on the side wall 16 at one end of the side wall opening 22 and extends outwardly from the side wall 16. There is a lock opening 42 in the tab 40 of a size to accommodate insertion of a lock shank.

Turning to FIG. 3, the other component of the doorknob security device is shown, an inner closure panel indicated generally by the numeral 50. The closure panel 50 is of a hollow cylindrical shape sized to nest within the outer housing 12. The inner closure panel is formed by a partial circumferential side wall 52 and a back wall 54.

Similarly to the outer housing 12, the closure panel 50 includes a doorknob access opening 60 comprising a side wall opening or cut out 56 which also extends about 150 degrees around the circumferential side wall 52, and a keyhole shaped opening 58 contiguous with the side wall cut out 56. The keyhole-shaped opening 58 is formed by a circular opening centered in the back wall 54 and a slot extending radially to connect with the side wall cut out 56. The keyhole-shaped opening 58 is defined by the edges **58*a* and 58*b* of the slot opening and an arcuate stem opening flange 58*c*. Flange 58*c* is also directed towards the interior of the closure panel 50**.

The side wall 52 is delimited by a front guiding edge 62 except where guiding edge 62 is interrupted by side wall opening 56. The side wall opening 56 is bounded on one side by flange 64.

A locking tab 68 is provided on the side wall 52 at one end of the side opening 56 and extends outwardly from the side wall 52. The tab 68 is positioned so that a lip **52*a* is formed between tab 68 and side wall opening 56. Locking tab 68 includes a lock opening 70**.

Figure 4:
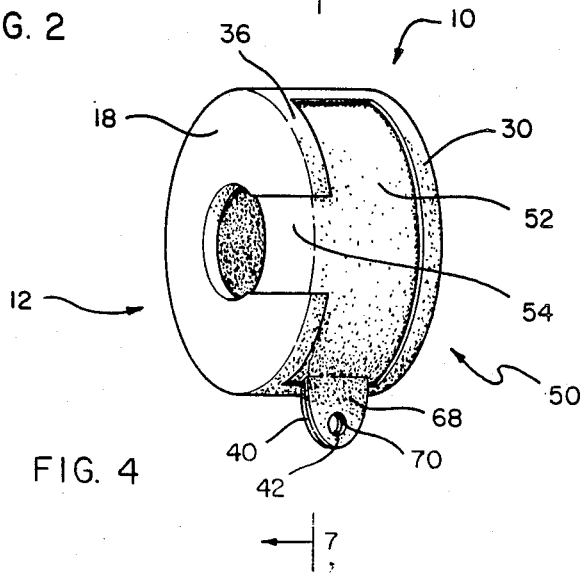
FIG. 4 is a perspective view of the doorknob security device rotated the closed position.

FIG. 4 illustrates the inner closure panel 50 rotatably mounted inside outer housing 12 and rotated to a closed position. It is seen that in the closed position flanges 30 and 36 in outer housing 12 overlap the side wall 52 of inner closure panel 50 and back wall 18 of outer housing 12 overlaps back wall 54 of inner closure panel 50. Also, the two locking tabs 40 and 68 on outer housing 12 and inner closure panel 50, respectively, align so that a lock shank may be inserted through the lock openings 42 and 70.

Figure 6:
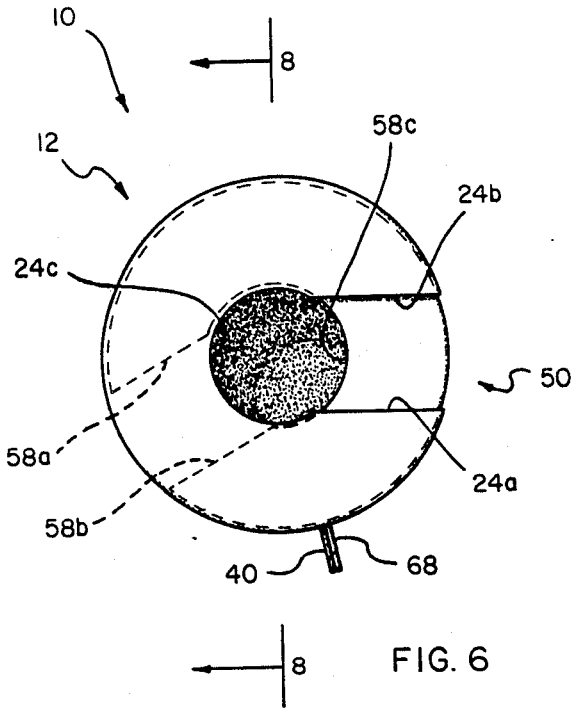
FIG. 6 is a rear elevational view of the doorknob security device in the closed position.

It is seen additionally in FIG. 4 that once the doorknob security device 10 is in the closed position the only opening remaining is that defined by the flange **24*c* in outer housing 12 and the flange 58*c* in inner closure panel 50. Flange 24*c* laps inside of flange 58*c*. FIG. 6 also illustrates the inner closure panel in the closed position. It is noted that the opening 58 is offset with respect to the opening 24** approximately 150 degrees.

Figure 5:
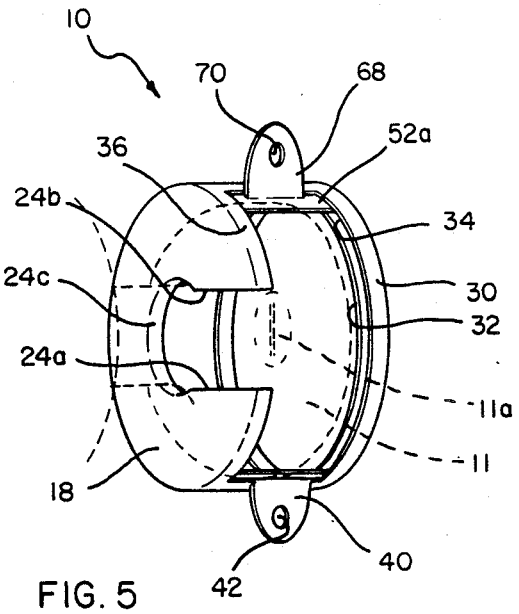
FIG. 5 is a perspective view of the doorknob security device rotated to the open position.

FIG. 5 shows the doorknob security device 10 with the inner closure panel 50 rotated to an open position and positioned over a doorknob 11. It is seen in this figure that the guiding edge 62 of the inner closure panel 50 rotatively slides in the track 34 in the outer housing 12.

Figure 7:
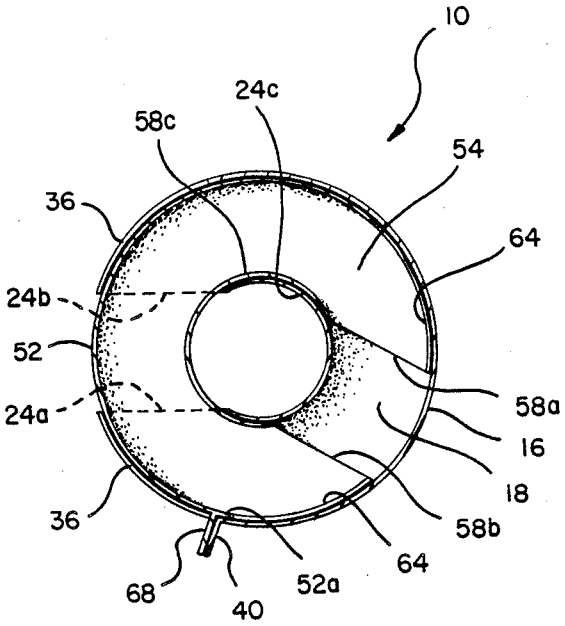
FIG. 7 is a cross-sectional view of the doorknob security device taken along the line 7—7 in FIG. 4.

When the doorknob security device 10 is in the open position (FIG. 5) the keyhole-shaped openings 24 and 58 and the side wall openings 22 and 56 in the outer housing 12 and the inner closure panel 50, respectively, are aligned in order to permit the device 10 to be easily slipped on (or off) a doorknob. The handle part of the doorknob slips through the aligned side openings 22 and 56 while the doorknob stem passes through the aligned keyhole-shaped openings 24 and 58 until the stem reaches the circular parts of said openings defined by flanges **24*c* and 58*c*. When the closure panel is rotated to the closed position the doorknob stem is completely surrounded by the overlapping flanges 24*c* and 58*c* as indicated in FIGS. 4 and 6. Note in FIG. 7 the lip 52*a* on the side wall 52 of closure panel 50 underlaps the side wall 16 of outer housing 12**.

Figure 8:
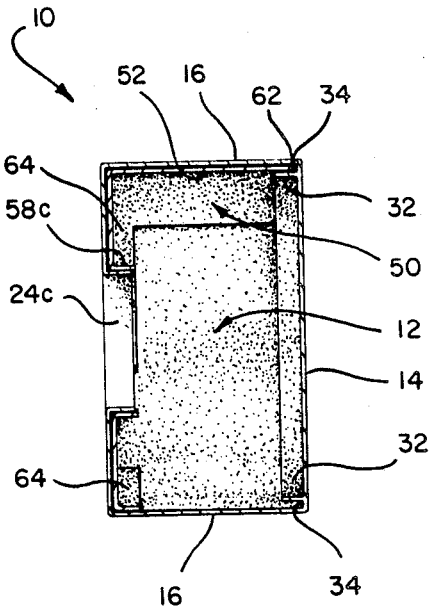
FIG. 8 is a cross-sectional view of the doorknob security device taken along the line 8—8 in FIG. 6.

FIG. 8 shows a transverse cross-sectional view of the doorknob security device. Note the manner in which the closure panel 50 nests inside the outer housing 12. In particular, the guiding edge 62 of the closure panel side wall 52 rotatively fits into the groove or track 34 formed between the inner flange 32 and the side wall 16 of the outer housing 12. Also, turning to the rear portion of the doorknob security device 10, it is seen that the circular flange **24*c* on the outer housing 12 extending inwardly of the device 10, fits within the circular flange 58*c* on the closure panel 50**.

Figure 1:
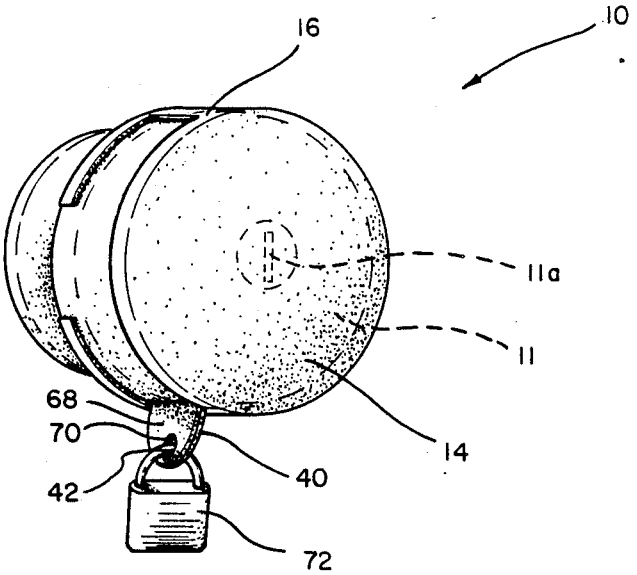
FIG. 1 is a perspective view of the doorknob security device shown in the closed and locked position.

From the foregoing description of a doorknob security device, it is appreciated that the present invention provides for such a device superior in several ways. As illustrated in FIG. 1, the doorknob security device of the present invention 10 completely encloses a doorknob 11, thus preventing access to the key slot **11*a*. The doorknob security device 10 is lockable by insertion of the shank of a lock 72 through the lock openings 42 and 70 in the locking tabs 40 and 68 or by any other suitable locking means. The overlapping design of this device is a protective measure against it being pried apart by a blade, screwdriver or the like. Finally, the doorknob security device 10** described herein, since it need not fit tightly around a doorknob, is able to turn freely about the knob. That is, the device spins freely while the knob remains stationary. This prevents a person breaking a glass in a door and reaching in to turn the knob from the inside or entering the premises through a window and attempting to exit through the door.

What is claimed is:

1. A doorknob security device comprising:

(a) a first doorknob enclosing a means; and (b) a second doorknob enclosing means disposed in rotational relationship with the first doorknob enclosing means, and wherein the first and second doorknob enclosing means form an internal cavity in which a doorknob may be substantially enclosed;

(c) the second doorknob enclosing means being contained within the first doorknob enclosing means and wherein the first and second doorknob enclosing means are rotatively movable between an open position and a closed position; and (d) wherein in the open position there is formed a doorknob access opening that permits the doorknob security device to be placed over the doorknob and wherein in the closed position the doorknob is securely held within the security device and access is not permitted to the keyhole of the doorknob.

2. The doorknob security device of claim 1 wherein the first and second doorknob enclosing means include a pair of openings, each opening having a surrounding edge structure and wherein the surrounding edge structures of the respective enclosing means are overlapped so as to form a relatively rigid and durable doorknob security device.

3. A doorknob security device comprising:

(a) an outer housing for enclosing a doorknob comprising a front wall, a back wall, and a circumferential side wall having a substantial opening therein so as to allow the outer housing to be placed over a doorknob;

(b) the outer housing further comprising an internal space wherein a track is located;

(c) an inner housing contained within the outer housing and comprising a back wall and a circumferential side wall having a substantial opening therein so as to allow the inner housing to be placed over a doorknob; and (d) wherein the side wall of the inner housing includes an edge confined within the track of the outer housing, allowing the inner housing to freely rotate within the outer housing.

4. The doorknob security device of claim 3 wherein the openings in the side walls of the outer housing and the inner housing are aligned when the device is rotated to an open position.

5. The doorknob security device of claim 4 wherein the device is lockable by locking when in a closed position.

6. A rotatable doorknob security device for receiving a doorknob and enclosing the same so as to prevent access to the keyhole formed within the doorknob, comprising:

(a) a cylindrical outer housing for receiving and enclosing a doorknob including a front wall, a back wall, a partial circumferential side wall and a doorknob access opening including a side wall opening to allow passage of a doorknob and a back wall opening to allow passage of a doorknob stem;

(b) an inner partial cylindrical housing rotatively mounted within the outer housing and rotatable between open and closed positions;

(c) the partial cylindrical housing including a back wall and a partial circumferential side wall and wherein there is defined within the partial cylindrical housing a side wall opening for allowing passage of a doorknob and a back wall opening for allowing passage of a doorknob stem;

(d) a circumferential track formed internally within the outer housing and wherein the side wall of the inner partial cylindrical housing is confined within the track so as to allow the inner partial cylindrical housing to rotate within the outer housing; and (e) wherein the inner partial cylindrical housing is rotatable between an open and closed position and wherein in the open position the doorknob access openings in the outer housing and inner partial cylindrical housing are aligned such that a doorknob can be inserted therethrough and wherein in the closed position the partial side wall of the inner partial cylindrical housing is rotated so as to close the side opening within the outer housing and to form a complete side wall closure around the security device while allowing the doorknob stem to project through the back wall openings of both the outer housing and the inner partial cylindrical housing.

* * * * *